US006193394B1

(12) United States Patent
Herst et al.

(10) Patent No.: US 6,193,394 B1
(45) **Date of Patent: *Feb. 27, 2001**

(54) DIRECT-INDIRECT LUMINAIRE HAVING IMPROVED DOWN LIGHT GLARE CONTROL

(75) Inventors: Douglas J. Herst, Ross; Peter Y. Y. Ngai, Alamo, both of CA (US)

(73) Assignee: NSI Enterprises, Inc., Atlanta, GA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/662,329

(22) Filed: Jun. 12, 1996

Related U.S. Application Data

(63) Continuation of application No. 08/400,325, filed on Mar. 9, 1995.

(51) Int. Cl.[7] ..... F21V 7/09

(52) U.S. Cl. ..... 362/260; 362/225; 362/298; 362/346

(58) Field of Search ..... 362/217, 221, 362/225, 260, 298, 342, 346, 223, 290

(56) References Cited

U.S. PATENT DOCUMENTS

| | | | | |
|---|---|---|---|---|
| 2,874,271 | * | 2/1959 | Lipscomb | 362/223 |
| 3,389,246 | * | 6/1968 | Shemitz | 362/147 |
| 4,768,140 | * | 8/1988 | Szpur | 362/346 |
| 4,939,627 | | 7/1990 | Herst et al. . | |
| 5,192,128 | * | 3/1993 | Ngai | 362/225 |

FOREIGN PATENT DOCUMENTS

| | | | | |
|---|---|---|---|---|
| 0064805 | * | 3/1991 | (JP) | 362/260 |

* cited by examiner

*Primary Examiner*—Y. Quach
(74) *Attorney, Agent, or Firm*—Donald L. Beeson

(57) ABSTRACT

A direct-indirect luminaire has a housing and down light passage areas in the bottom of the housing through which the direct lighting component of the luminaire is produced. Lamps mounted in the housing in proximity to the down light passage areas are shielded from any line of sight exposure by means of a laterally extending shielding element positioned between the down light passage area and the lamps. Preferably, the laterally extending shielding element extends a distance sufficient only to prevent lamp sight exposure of the lamps through the down light passage area.

9 Claims, 3 Drawing Sheets

DIRECT-INDIRECT LUMINAIRE HAVING IMPROVED DOWN LIGHT GLARE CONTROL

This application is a continuation of application application Ser. No. 08/400,325 filed Mar. 9, 1995, now pending.

BACKGROUND OF THE INVENTION

The present invention generally relates to architectural lighting, and more particularly relates to luminaires that provide both direct and indirect lighting, so-called "direct-indirect" luminaires. The invention finds particular application in the field of linear fluorescent lighting where ambient light is produced from fluorescent lamps mounted in an elongated housing having a predetermined length and characteristic cross-sectional shape.

Linear direct-indirect lighting has been known for many years. Such fixtures normally provide indirect or "up" lighting through the top of the luminaire housing which is open (or is covered by a light transmitting element such as a lens cover), and a direct or "down" lighting component through one or more openings in the bottom of the housing, openings which are typically covered by lenses, baffles, or louvers to shield the luminaire's fluorescent lamps from direct view. Such shielding is desirable since exposure of the lighting emitting surfaces of the lamps within the luminaire through the direct light openings can produce uncomfortable visible brightness and distracting glare on work surfaces.

The disadvantage with existing direct-indirect lighting luminaires is that in many designs, the lamps are not adequately shielded from all viewing angles from below the luminaire leading to a condition where, at certain angles, the bright surfaces of the lamps project through the luminaire's down light openings with detrimental consequences to the lighting environment. In the present invention, the lamps of a direct-indirect luminaire are totally shielded from view through the fixture's down light openings regardless of the viewing angle. At the same time the amount of light available to the down light openings can be maximized.

SUMMARY OF THE INVENTION

Briefly, the invention involves a direct-indirect luminaire comprised of a housing having an up light opening and at least one down light passage area. A light source is mounted in the housing for producing indirect light through the housing's up light opening and a direct lighting component through its down light passage area. The down light passage area can be any opening or combination of openings through which light can pass through the bottom of the housing, for example, the passage area can be an elongated completely open slot or a baffle plates having a series of punched openings along its length. To shield the light source from direct view at any viewing angle from below the luminaire, a shielding element is mounted internally of the housing to laterally extend between the light source and the down light passage area so as to prevent any line of sight exposure of the light source through the light passage area. Preferably, the shielding element will extend laterally in the direction of the light passage area a distance that is only sufficient to prevent line of sight exposure of the light source surfaces. Further extension of the shielding element would reduce the amount of source light available to the light passage area thereby reducing the down light component of the luminaire.

In the illustrated embodiment the direct-indirect luminaire of the invention has an elongated housing with at least one elongated light passage area having an interior edge and an anterior edge extending longitudinally of the housing. A light source, suitably a linear fluorescent lamp, is mounted to extend generally above and in line with the interior edge of the down light passage area while the shielding element extends both longitudinally of the housing generally over the interior edge of the light passage area and laterally toward the anterior edge of the light passage area a sufficient distance to prevent line of sight exposure of the light source. Preferably, a primary reflector surface extends internally of the housing from the anterior edge of the light passage area for reflecting source light onto the light passage area and a secondary reflector surface extends internally of the housing from the interior edge of the down light passage area for redirecting source light onto the down light passage area received from the primary reflector surface. Suitably, the secondary reflector surface and shielding element can be fabricated of a single bent metal reflector element. It is contemplated that the primary reflector will be a substantially diffuse reflector, while the secondary reflector range from diffuse to specular.

Therefore, it is a primary object of the present invention to provide a direct-indirect luminaire which reduces the potential for uncomfortable source brightness or distracting glare. It is a further object of the invention to achieve the foregoing objective while having the ability to maximize the amount of source light available through the down light passage area of the luminaire. It is a further object of the invention to provide a direct-indirect luminaire which is relatively simple in construction. Other objects of the invention will be apparent from the following specification and claims.

DETAILED DESCRIPTION OF THE ILLUSTRATED EMBODIMENT

Figure 1:
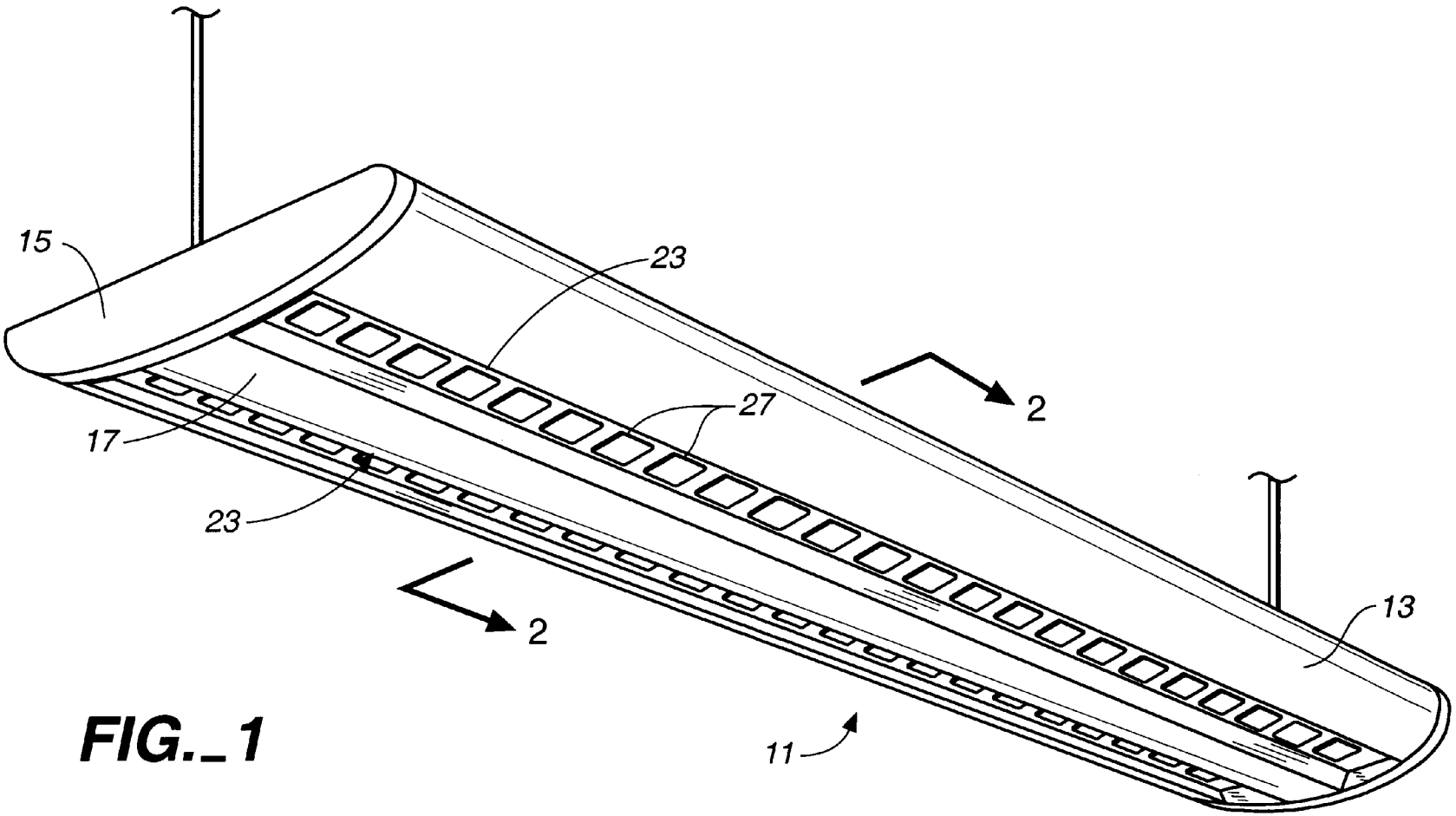
FIG. 1 is a bottom perspective view of a direct-indirect luminaire having down light passage areas in the bottom of the luminaire housing for producing a direct lighting component from the luminaire.
Figure 2:
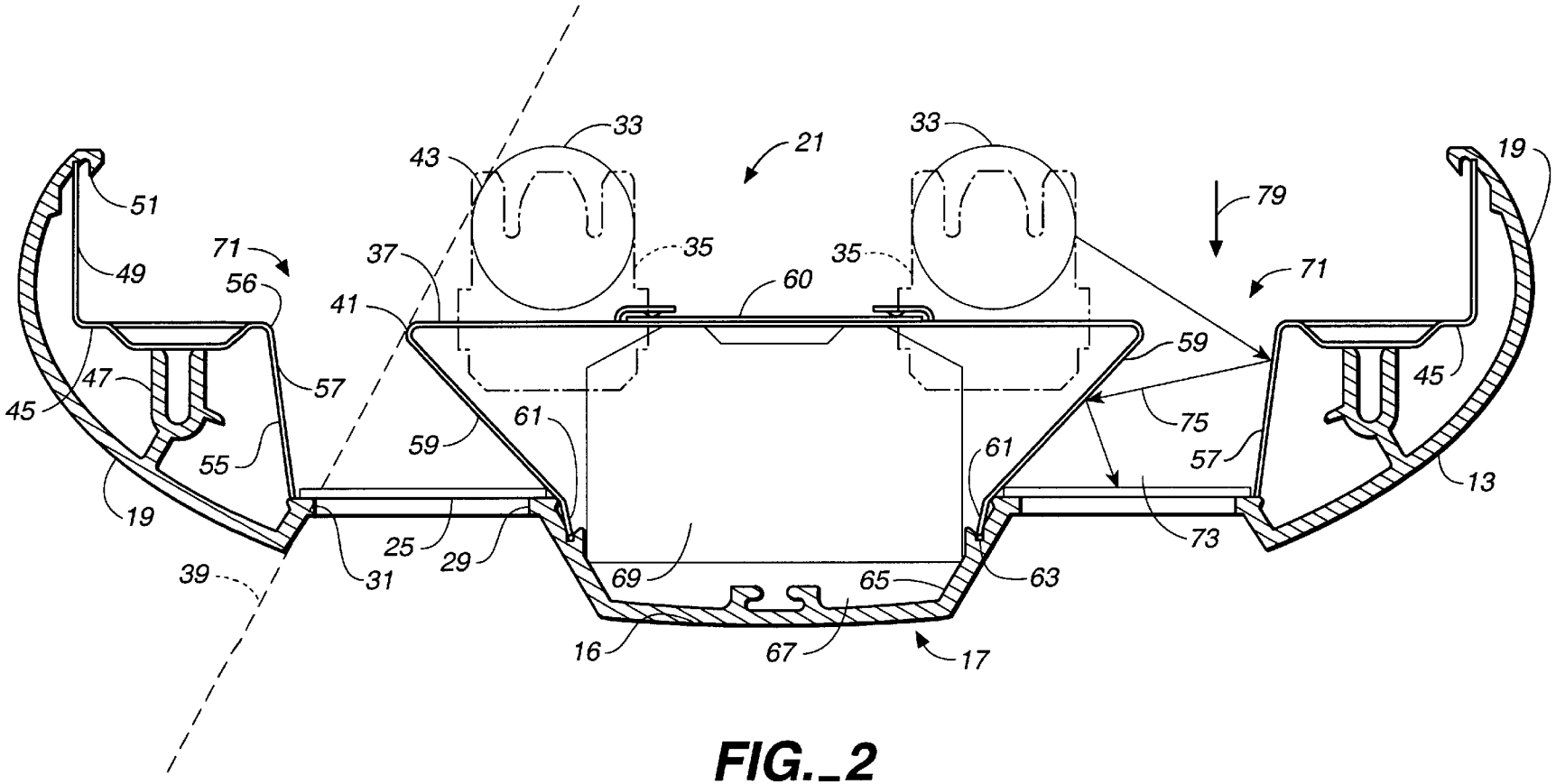
FIG. 2 is a cross-sectional view of the luminaire shown in FIG. 1 taken along lines 2-2, showing in detail a direct-indirect luminaire in accordance with the invention.

Referring now to the drawings, a suspended linear fluorescent direct-indirect luminaire in accordance with the invention is shown and denoted by the numeral 11. The luminaire includes an elongated housing 13, suitably fabricated of extruded aluminum terminated by end caps 15. The housing has a bottom portion 17 and upwardly extending side walls 19, the upper extremes of which define up light opening 21 through which a major portion of the available direct and reflected source light is emitted. Source light emitted through this opening is reflected from overhead ceiling surfaces (not shown) and adjacent upper wall surfaces, if any, to produce indirect lighting within the architectural space in which the luminaire is installed. The bottom portion 17 of the housing, in turn, has two elongated down light passage areas 23 extending the length of the housing for passing some of the available source light downward through the bottom of the housing, thus producing some down lighting. In the illustrated embodiment, the light passage areas are provided in the form of baffle plates 25 having rectangular openings 27 through which the down lighting component of the luminaire passes. It is understood that down light passage areas 23 can be designed in any manner that passes light through the bottom of the luminaire housing. For example, they can be completely open, that is, in the form of elongated openings extending along the length of the housing which have no baffle plate or other structure obstructing the opening. Other examples include the use of baffle plates having a pattern of smaller punched holes or slots.

Figure 3:
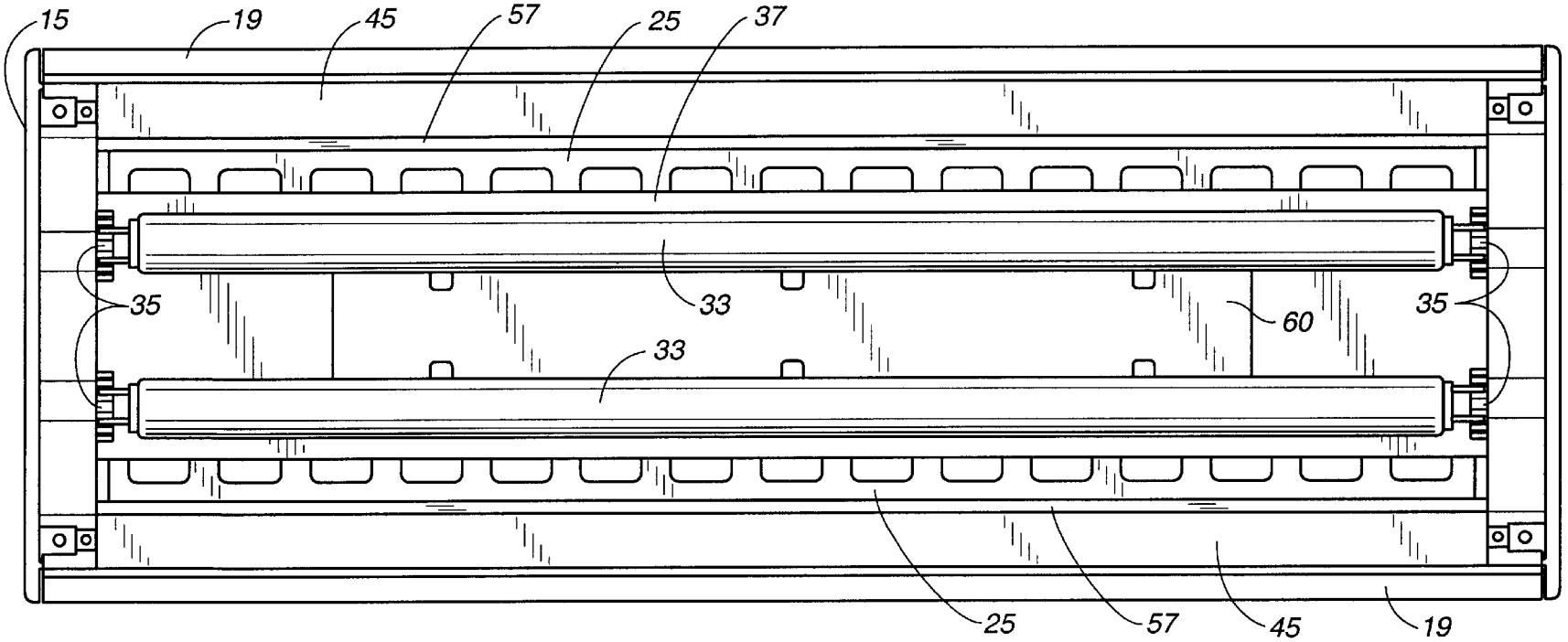
FIG. 3 is a top plan view thereof.

Regardless of the presence or absence of a baffle or other structure, the elongated down light passage areas are generally defined by an interior edge 29 closest to the center of the fixture and anterior edge 31 which is closest to housing side walls 19. Fluorescent lamps 33, mounted in the housing by means of lamp sockets 35, are seen to be positioned generally above and in line with each of the interior edges 29 of the housing's down light passage areas so as to produce indirect lighting through up light opening 21 and from which the down lighting component of the luminaire is produced as hereinafter described. The invention provides that line of sight exposure of fluorescent lamps 33 through any portion of the light passage areas 23 is prevented by means of a shielding element 37 mounted in the housing between the fluorescent lamps and the light passage areas. As best seen in FIG. 3, the shielding element takes the form of a horizontal reflector element which extends laterally under the lamps past interior edge 29 of each light passage area in the direction of the light passage area's anterior edge 31. To prevent line of sight exposure to any portion of the surface of the lamps, the shielding element must extend a sufficient distance to reach a line of sight cut-off angle, denoted by dashed line 39, which ensures that no portion of the lamp surfaces are exposed through the down light passage areas which could create uncomfortable brightness or distracting glare. It can be seen that the line of sight cut-off angle extends along a line that generally intersects anterior edge 31 of each light passage area and that is tangent to the outside of the fluorescent at 43. Extension of lateral edges 41 of the shielding element beyond this line of sight cut-off, while permissible within the scope of the invention, will act to decrease the amount of source light available to the down light passage areas and hence the amount of down light from the luminaire.

Shielding element 37, as mentioned, is preferably a reflector element and forms part of the luminaire's overall reflector system which includes side reflectors 45 mounted next to side walls 19 of the housing on extruded screw channels 47 by means of suitable screw fasteners (not shown). Each side reflector 45 consists of an elongated bent reflector element having a top leg 49 which engages into interior retaining groove 51 formed along the top rim of the housing side walls. Each side reflector additionally has a bottom leg 55 that extends to the anterior edge 31 of the down light passage area adjacent the side reflector. The side reflector's bottom leg 55 provides a primary, preferably diffuse, reflector surface 57 that extends internally of the housing from its associated down light passage area to reflect available source light onto light passage area 23. Interior secondary reflector surfaces 59 are additionally provided opposite the primary reflector surfaces associated with both the down light passage areas. Such secondary reflector surfaces extend from the interior edges 29 of the light passage areas at an inclined angle so as to meet shielding element 37 at the shielding element's lateral edges 41. Suitably, interior secondary reflector surfaces 59 and shielding element 37 are provided by a single bent metal central reflector part 60 which is installed in the central portion 16 of the housing by inserting tensioned edges 61 of this part into bottom retaining grooves 63 extruded into the housing's interior walls 65. The central reflector part 60 can generally be seen to form a central cavity 67 in which a lamp ballast 69 can be mounted.

It can also be seen that lateral edges 41 of shielding element 37, together with top edges 56 of the bottom leg of the side reflector form an internal openings 71 through which source light from fluorescent lamps 33 can be admitted to the interior regions 73 above the housing's down light passage areas 23. Source light admitted to this region will either come directly from the lamp surfaces as denoted by ray trace arrow 75 or will be source light reflected back from adjacent surfaces, such as an overhead ceiling surface (not shown), as denoted by ray trace arrow 79. In either case, there is no direct exposure of the lamps through the down light passage area of the housing due to the positioning of shielding element. With reference to ray trace 75, it is also noted that secondary reflector surface 59 will act to redirect light received from primary reflector surface 57 onto the down light passage areas 23. Thus, substantially all of the light passing through interior openings 71 will reach the down light passage areas either directly or through internal reflections within the interior regions 73. As discussed above, it is generally desired to maximize the size of interior openings 71 without exposing the lamp surfaces so as to maximize the light available to the down light passage areas.

To prevent source brightness from being reflected through the primary and secondary reflector surfaces of interior regions 73, the primary reflector surface should be a substantially diffuse reflecting surface, such as a surface that has been painted white. Secondary reflector surfaces 59, on the other hand, can suitably be any type of reflector ranging from diffuse to totally specular.

Therefore, it can be seen that the present invention provides a direct-indirect luminaire wherein a down light component is provided from the bottom of the luminaire housing without exposing lamp surfaces from any position below the luminaire. While the invention has been described in considerable detail in the foregoing specification and the accompanying drawings, it is understood that it is not intended that the invention be limited to such detail, except as necessitated by the following claims.

What we claim is:

1. A direct-indirect luminaire comprising an elongated housing having an up light opening and a bottom portion having at least one elongated down light passage area extending longitudinally along the bottom portion of said housing, said light passage area having an interior edge and anterior edge, a light source mounted in said housing extending generally above and in line with the interior edge of said down light passage area, said light source providing source light that is emitted through both said up light opening for producing indirect lighting and through said down light passage area for producing direct lighting from the bottom portion of said housing, an elongated shielding element mounted in said housing between said light source and said down light passage area, said shielding element extending longitudinally of said housing generally over the interior edge of said down light passage area and also extending laterally toward the anterior edge thereof a sufficient distance to prevent line of sight exposure of said light source through said light passage area, and a primary reflector surface extending internally of the housing from near the anterior edge of said light passage area for receiving and reflecting source light before the source light passes through said light passage area.

2. The direct-indirect luminaire of claim 1 further comprising a secondary reflector surface extending internally of the housing from near the interior edge of said down light passage area for redirecting onto said down light passage area source light received from said primary reflector surface.

3. The direct-indirect luminaire of claim 2 wherein said shielding element has a defined lateral edge over said down light passage area and wherein said secondary reflector surface extends in an inclined plane from the interior edge of said down light passage area toward the lateral edge of said shielding element.

4. The direct-indirect luminaire of claim 3 wherein said shielding element and secondary reflector surface are fabricated from a single bent metal reflector part.

5. The direct-indirect luminaire of claim 1 wherein said shielding element extends laterally toward the anterior edge of said down light passage area substantially only a distance sufficient to prevent line of sight exposure of said light source through said light passage area.

6. A direct-indirect luminaire comprising an elongated housing having an up light opening and a bottom portion having two elongated down light passage areas extending in parallel relation longitudinally of said housing, each of said light passage areas having an interior edge and anterior edge, socket means in said housing for mounting a linear source of light generally above and in line with the interior edge of each of said down light passage areas, each linear source of light providing source light that is emitted through both said up light opening for producing indirect lighting and through its associated down light passage area for producing direct lighting from the bottom portion of said housing, and an elongated shielding element mounted in said housing between said linear sources of light and said down light passage areas, said shielding element extending longitudinally of said housing along said down light passage areas and also extending laterally toward the anterior edge of each down light passage area a sufficient distance to prevent line of sight exposure of said light source through said light passage area.

7. The direct-indirect luminaire of claim 6 further comprising a primary reflector surface extending internally of the housing from near the anterior edge of each of said light passage areas for receiving source light and reflecting said received source light before the source light passes through said light passage area.

8. The direct-indirect luminaire of claim 7 further comprising a secondary reflector surface extending internally of the housing from near the interior edge of each of said down light passage areas for redirecting onto each of said down light passage areas source light received from said primary reflector surface.

9. The direct-indirect luminaire of claim 8 wherein said shielding element and the secondary reflector surface associated with each down light passage area are fabricated from a single bent metal reflector part which form a ballast cavity between said light passage areas.

* * * * *